US007810833B2

(12) United States Patent
Ettlinger et al.

(10) Patent No.: US 7,810,833 B2
(45) Date of Patent: Oct. 12, 2010

(54) SKI BINDING HAVING A DYNAMICALLY VARIABLE UPWARD HEEL RELEASE THRESHOLD

(75) Inventors: Carl F. Ettlinger, Underhill Center, VT (US); David J. Dodge, Williston, VT (US)

(73) Assignee: Vermont Safety Developments, Underhill Center, VT (US)

( * ) Notice: Subject to any disclaimer, the term of this patent is extended or adjusted under 35 U.S.C. 154(b) by 739 days.

(21) Appl. No.: 11/353,827

(22) Filed: Feb. 14, 2006

(65) Prior Publication Data

US 2006/0192365 A1 Aug. 31, 2006

Related U.S. Application Data

(60) Provisional application No. 60/652,977, filed on Feb. 14, 2005.

(51) Int. Cl.
*A63C 9/00* (2006.01)

(52) U.S. Cl. ..... 280/617; 280/623; 280/633; 280/634

(58) Field of Classification Search ..... 280/602, 280/601, 11.12, 611, 841, 7.13, 7.12, 7.1, 280/87.01, 617, 623, 625, 626, 633, 634
See application file for complete search history.

(56) References Cited

U.S. PATENT DOCUMENTS

| | | | | |
|---|---|---|---|---|
| 3,091,475 A | | 5/1963 | Wunder | |
| 4,674,766 A | * | 6/1987 | Ramer | 280/614 |
| 4,915,405 A | * | 4/1990 | Rullier et al. | 280/634 |
| 5,064,215 A | | 11/1991 | Ferdinand et al. | |
| 5,071,155 A | | 12/1991 | Stepanek et al. | |
| 5,092,621 A | * | 3/1992 | Horn | 280/618 |
| 5,431,427 A | | 7/1995 | Pieber et al. | 280/607 |
| 5,551,720 A | | 9/1996 | Ruffinengo | |
| 5,722,681 A | | 3/1998 | Merino | |
| 6,450,526 B1 | | 9/2002 | Bressand | |
| 7,063,345 B2 | | 6/2006 | Holzer | |
| 7,086,662 B2 | | 8/2006 | Dodge | |
| 2004/0145154 A1 | | 7/2004 | Holzer | |
| 2004/0173994 A1 | * | 9/2004 | Howell | 280/628 |

(Continued)

FOREIGN PATENT DOCUMENTS

EP 0385943 A1 9/1990

(Continued)

OTHER PUBLICATIONS

"Where Do We Go From Here?"; Ettlinger, C.F., Johnson, R.J. and Shealy, J.E.; *Skiing Trauma and Safety*; Fourteenth Volume, ASTM STP 1440, pp. 53-63; 2003.

(Continued)

*Primary Examiner*—J. Allen Shriver, II
*Assistant Examiner*—Katy Meyer
(74) *Attorney, Agent, or Firm*—Downs Rachlin Martin PLLC

(57) ABSTRACT

A ski boot binding securable to an alpine ski. The binding includes a heel unit having a base heel release threshold in a direction perpendicular to the upper surface of the ski to which the binding is attached. The heel unit includes a compensation mechanism that dynamically changes the base heel release threshold as a function of force conditions encountered by the ski during skiing.

31 Claims, 9 Drawing Sheets

U.S. PATENT DOCUMENTS

2007/0090627 A1* 4/2007 Laurent ..... 280/612

FOREIGN PATENT DOCUMENTS

EP 0397603 A1 11/1990

OTHER PUBLICATIONS

Carl Ettlinger, The Salomon '37 Line, Skiing, Nov. 1982, pp. 175, 176, 178, 180.
Gordon Lipe, The ALLSOP-Pegged for Safety, Know Your Bindings: 18, Ziff-Davis Publishing Company, Oct. 1973.
Gordon Lipe, The Allmat 8000, Jet, and PSC, Know Your Bindings: 19, Nov. 1973, pp. 155, 158 and 163.
Gordon Lipe, The Americana: Heel Release on a Plate, Know Your Bindings: 21, pp. 12-14, published prior to Aug. 7, 2005.
Carl Ettlinger, Bindings Performance Report: The Salomon 727, Reprinted from Skiing Magazine, Oct. 1978, Ziff-Davis Publishing Company.
Carl Ettlinger, Bindings Performance Report: The Moog Delta S, Reprinted from Skiing Magazine, Nov. 1978, Ziff-Davis Publishing Company.
Carl Ettlinger, Bindings Performance Report: The Burt II, Reprinted from Skiing Magazine, Dec. 1978, Ziff-Davis Publishing Company.
Carl Ettlinger, Bindings Performance Report: The Tyrolia 60 Series, Reprinted from Skiing Magazine, Oct. 1979, Ziff-Davis Publishing Company.
Carl Ettlinger, Bindings Performance Report: The New Spademan Line, Reprinted from Skiing Magazine, Dec. 1979, Ziff-Davis Publishing Company.
Carl Ettlinger, Bindings Performance Report: Look Again, Reprinted from Skiing Magazine, Feb. 1983, Ziff-Davis Publishing Company, pp. 109-111.
Carl Ettlinger, How Your Bindings Work, Marker's Twincam Series, Skiing, Oct. 1987, pp. 225, 228, 230.
Carl Ettlinger, How Your Bindings Work, The Ess V.A.R., Skiing, Feb. 1988, pp. 94, 116.
Carl Ettlinger, The New Geze Line, Skiing, Oct. 1988, pp. 190, 192, 194.

* cited by examiner

SKI BINDING HAVING A DYNAMICALLY VARIABLE UPWARD HEEL RELEASE THRESHOLD

RELATED APPLICATION DATA

This application claims the benefit of priority of U.S. Provisional Patent Application Ser. No. 60/652,977, filed Feb. 14, 2005, and titled "Device For Improving The Release And Retention Performance Of Ski Bindings," that is incorporated by reference herein in its entirety.

FIELD OF THE INVENTION

The present invention generally relates to the field of ski bindings. In particular, the present invention is directed to a ski binding having a dynamically variable upward heel release threshold.

BACKGROUND OF THE INVENTION

In conventional alpine ski binding designs, release of a ski boot is by means of a toe unit that senses twist and a heel unit that senses upward forces applied by the heel of the boot. No other information is involved in the release/retain logic of the heel unit. The heel unit is intended to help protect a skier from injury caused by an excessive forward bending moment on the skier's lower leg. However, the force applied by the boot heel to the heel unit is not always an indication of the true bending moment on the leg. Inadvertent release of the heel unit among elite skiers and competitors occurs sporadically despite the wide-spread use of release settings well above the recommended safe settings. There are also conditions that can lead to bending-related injury to the lower leg in forward falls even when relatively low release settings are used.

Inadvertent release in the former scenario just mentioned is referred to as the "Bow Effect," based on the cause of the inadvertent release. This Bow Effect has characteristics similar to the situation in which an archer allows a bow to slip from their grasp while flexing the bow to install a bow string. In this case, energy stored in the flexed bow releases, thereby causing the bow to tend to move in the direction of the end not in contact with the ground. In skiing, the release generally follows the storing of flexural energy in the front portion of the ski in reaction to a bump or rut. When this stored flexural energy is released, it tends to propel the ski rearward relative to the boot. At any time the distributed load applied by the snow to the ski can be represented by a single vector. This vector is generally perpendicular to the bottom surface of the ski in the vicinity of the ball of the skier's foot. However, when the ski encounters a bump or rut, this vector moves forward and away from the ski boot. In the situation described as the Bow Effect, the vector has a large component parallel to the long axis of the sole of the ski boot, and if the skier does not have most of their bodyweight on that ski, the vector has a small component perpendicular to that axis.

In skiing, the moment experienced by the binding is calculated by multiplying the magnitude of the force vector on the ski by the perpendicular distance to the pivot point (fulcrum) between the boot and binding in a forward lean, whereas the bending moment experienced by the skier's leg at the same moment in time is calculated by multiplying the magnitude of the force vector on the ski by the perpendicular distance to the skier's boot top. Therefore, during a Bow Effect event, the moment experienced by the binding is much greater than the moment experienced by the skier's lower leg. When the binding releases, the lack of pressure between the upper cuff of the boot and the skier's lower leg causes the skier to classify the release as inadvertent and unnecessary. However, the trajectory of the ski in the direction opposite to the skier's direction of travel indicates the cause to be the Bow Effect.

The heel release itself is brought about by the skier driving their lower leg forward at the same time as the flexural energy in the front portion of the ski releases. The inadvertent simultaneity of these phenomena can put the skier's lower leg into tension, thereby pulling the heel unit open with little apparent effort. Increasing the release threshold of the heel unit does not necessarily eliminate the bow effect and, in fact, can cause injury to the skier during situations in which the heel unit should have released but did not because the released threshold was increased in attempt to counter the bow effect.

In 1985, one of the present inventors coauthored a paper titled "A Method For Improvement of Retention Characteristics in Alpine Ski Bindings," which had been presented at the fifth symposium of the International Society for Skiing Safety in Keystone, Colo., in 1983 and later published by the American Society for Testing and Materials (ASTM) as a special technical paper (STP) in ASTM STP 860. The paper is based on a study that included field observations and laboratory re-creations of the Bow Effect. Using a test method based on ASTM F504, a 50% drop in the measured bending moment on a simulated leg can be shown for the most extreme condition. Comparable increases in the release moment in a forward lean can also be measured in simulated "hard landing" situations following a jump, and in situations in which the skier is falling forward and, at the same time, the ski is going uphill (the tip of the ski is higher than the tail). These observations and re-creations demonstrate the generally unreliability of the traditional heel binding unit under extreme, but foreseeable, conditions. Among racers of all levels, as well as among some experienced recreational skiers, the problem has lead to a general loss of confidence in the sanctioned method for release threshold selection. What is needed, therefore, is an alpine ski binding that improves the release/retention performance of the heel unit of the binding by increasing or decreasing the force required to release the heel of a ski boot as required during skiing so that, at the release threshold, the bending moment on the leg is approximately the same.

ASTM F504-05 test 2.3 simulates a slow weighted forward fall and uses a load point on the ski defined as the "near point." On level ground it is the approximate balance point when a typical skier leans forward to the average limit of dorsiflexion. ASTM F504 does not define a test with a load point any closer to the boot. However, Sub-Near-Point loads are possible in alpine skiing when a skier falls forward as a ski encounters a rut or bump with a sharp uphill transition. As the ski encounters the steep transition, it is at first decelerated, which can throw an unprepared skier forward. Then, as the ski rides up the slope of the obstruction and the portion of the ski under the boot enters the transition, the skier's boot and lower leg experience a rapid angular acceleration as the boot toe rotates upward. This motion can snap the knee joint of the unprepared skier (who is already falling forward) into full extension. The ski and boot then accelerate upward relative to the skier's center of gravity, creating a more than one-g loading environment for the lower leg. At injury, the resultant force vector on the ski is closer to the boot than the ASTM-defined near-point and has a small component in the direction of the long axis of the boot pushing the ski forward away from the boot and a large component perpendicular to the long axis of the boot. In this situation, the perpendicular distance from the resultant force vector on the ski to the pivot point of the binding is much shorter than the distance to the boot top. Therefore, the leg experiences a much greater moment than the binding.

In summary, the resultant force vector on the ski during inadvertent release by the Bow Effect is located near the tip of the ski and has a large component parallel to the long axis of the sole of the boot and a small component perpendicular to this long axis. In contrast, the resultant force vector on the ski during injury due to Sub-Near-Point loading is located closer to the boot than the near-point and has a small negative component parallel to the long axis of the sole of the boot and a large component perpendicular to this long axis. The near-point is located approximately at a distance of 25% of the skier's height forward of the skier's lower leg.

SUMMARY OF THE INVENTION

In one aspect, the present invention is directed to a ski binding configured to be secured to a snow ski and to retain a ski boot having a heel and a toe. The binding comprises a heel unit having a releasing heel retainer having a retaining state and a released state. The releasing heel retainer is configured to inhibit movement of the heel of the ski boot when in the retaining state. The heel retainer has an uplift release threshold between the retaining state and the release state. An uplift-release-threshold compensator is operatively configured to change the uplift release threshold in response to predetermined input during use of the snow ski and when the binding is secured to the snow ski and the ski boot is retained in the ski binding.

In another aspect, the present invention is directed to a system comprising a snow ski and a binding secured to the snow ski and configured to retain a ski boot having a heel and a toe. The binding comprises a heel unit having a releasing heel retainer having a retaining state and a released state. The releasing heel retainer is configured to retain the heel of the ski boot when in the retaining state. The heel retainer has an uplift release threshold between the retaining state and the release state. An uplift-release-threshold compensator is operatively configured to change the uplift release threshold in response to predetermined input during use of the snow ski and when the ski boot is retained in the binding.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION

Figure 1:
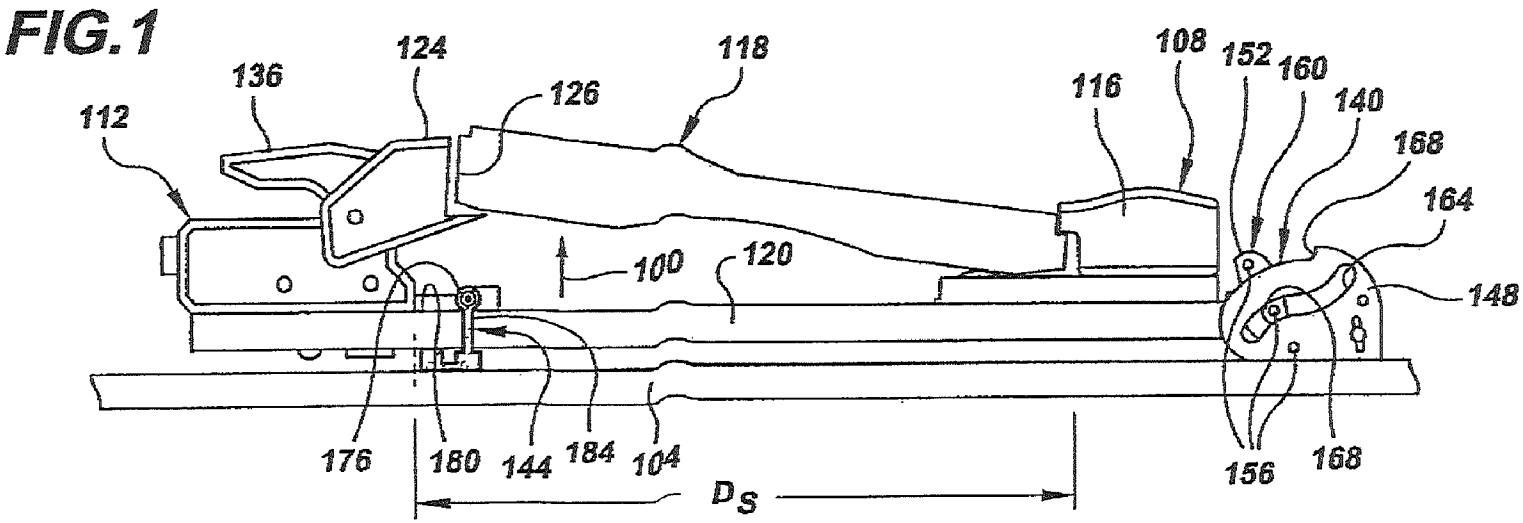
FIG. 1 is an elevational view of a binding of the present invention mounted on a snow ski and showing the binding in a released state with a ski boot about to engage the binding.

In general, the present invention is directed to reducing the likelihood of injury to an alpine skier when a ski experiences certain forces, such as occur in connection with the Bow Effect and Sub-Near-Point loading conditions described in the Background section above. All known contemporary alpine ski boot bindings include a heel unit having a "heel cup," or similar retainer, that releasably secures a ski boot to the ski in part by retaining a heel lug protruding rearward from the heel of the boot. Virtually every contemporary heel unit has a release threshold adjusting mechanism that allows the ski setup professional to set the "upward" heel release threshold of the heel unit to a value appropriate to the user of the ski. (As used herein and the claims appended hereto, the word "upward" and like words mean in a direction perpendicular to, away from, the face of the ski on which the binding is mounted. For reference, arrow 100 in FIG. 1 is pointing upward relative to ski 104.) In general, the upward heel release threshold is equal to the maximum substantially upward force applied by the heel lug that the heel retainer can resist before the heel unit releases the heel. This release threshold is typically set as a function of, among other things, the skier's weight, height and age, as well as the type of skiing the skier will perform, i.e., either slow skiing on gentle terrain to fast skiing on steep slopes. Once the upward heel release threshold has been set, it does not vary, other than minutely in response to temperature changes, regardless of the forces that ski undergoes during use or the loads actually applied to the leg.

In contrast to conventional alpine ski bindings, an alpine ski binding of the present invention includes various features that provide the heel unit with an upward heel release threshold that varies in response to differing force conditions the ski experiences during use. Conventional heel units only sense and respond to a force applied by the heel of the ski boot in a direction perpendicular to, and in a direction away from, the upper surface of the ski. This force is not a good indication of the true bending moment on the skier's lower leg. The present invention includes sensing loads both parallel and perpendicular to the long axis of the sole of the boot that are most likely to create a disparity between what the binding and leg each sense and biasing the heel release threshold of the heel unit so as to compensate for this disparity. Forward (or backward) movement of the boot relative to the ski influences the forward lean release of the binding. This principle may be also applied to the longitudinal force required to hold the boot in place on the ski as the ski accelerates or decelerates relative to the long axis of the ski boot sole. The force required to release the heel piece increase as the boot moves forward and. may as an option, decreases as the boot moves rearward on the ski. The downward force of the skier's fore foot may also be used to influence release and retention. A high downward force would inhibit forward movement of the boot and aid rearward movement thereby facilitating a decrease in the force required to release the heel piece.

As described in the Background section above, the Bow Effect tends to cause a heel unit to release the heel lug when release is not desired, and Sub-Near-Point Loading tends to cause a condition in which a heel unit continues to retain the heel lug when retention is not desired. As discussed below in detail, a ski binding of the present invention may be configured to, among other things, 1) increase the upward heel release threshold in response to one or more conditions, e.g., forces, accelerations, relative displacements, etc., present during the Bow Effect, 2) decrease the upward heel release threshold in response to one or more conditions present (again, forces, accelerations, relative displacements, etc.) present during Sub-Near-Point Loading, or 3) both.

FIG. 1 illustrates an alpine ski binding 108 of the present invention that has the ability to change the upward heel release threshold to compensate for both the Bow Effect and Sub-Near-Point Loading. As will become apparent from the following description, this release threshold compensation in this particular embodiment of binding 108 is provided as a function of the relative movement between the binding and ski 104. Binding 108 may be mounted to ski 104, which may be a conventional alpine snow ski, in the same location where a conventional binding would be mounted. Like a conventional binding, binding 108 may include a heel unit 112 and a toe unit 116 spaced from the heel unit by a set distance Ds appropriate for the size of the ski boot, e.g., the ski boot represented by boot sole 118 that will be used with the binding. Indeed, in some embodiments of the present invention, toe unit 116 may be a conventional toe unit available from current manufacturers, such as Marker USA, West Lebanon, N.H. and HTM Sport-und Freizeitgeräte AG (Tyrolia), Austria, among others. Heel unit 112 and toe unit 116 may be secured to a member 120, e.g., plate, extruded shape, space frame, adjustable length support, etc., that substantially maintains set distance Ds between the heel and toe units.

Heel unit 112 may comprise a heel retainer, such as the conventional pivoting heel cup 124 shown, that acts to retain the heel of the boot by releasingly engaging a heel lug 126 or other component(s) of the boot provided as part of the boot/binding retaining system. As discussed below in greater detail, heel unit 112 generally works in a substantially conventional manner. That is, heel cup 124 includes a cam surface 128 (FIG. 2) and a spring-biased cam follower 132 (FIG. 2) urged against the cam surface. As those skilled in the art will readily understand, the shape of cam surface 128 (FIG. 2) and the interaction of spring-biased cam follower 132 (FIG. 2) with the cam surface provides heel unit 112 with an upward heel release threshold, which, again, is defined at the largest generally upward force that heel cup 124 can resist before pivoting to the open position shown in FIG. 1, thereby releasing the heel of sole 118. Heel unit 112 may further include a release mechanism, such as the conventional release lever 136 shown, that allows a user to release the heel of sole 118 on demand.

As mentioned above, binding 108 shown in FIG. 1 is designed to change the magnitude of the upward heel release threshold of heel unit 112 as a function of relative movement between the binding (and the ski boot, which is represented by boot sole 118, that will be substantially fixedly clamped in the binding) and ski 104. Consequently, binding 108 is mounted to ski 104 so that it is movable relative to the ski over a range of motion necessary to provide heel unit 112 with its upward heel release threshold changing ability, again in this case the ability to both increase and decrease this threshold in response to, respectively, a Bow Effect condition and a Sub-Near-Point loading condition. In the embodiment shown, this movability is provided by a toe-end linkage mechanism 140 and a heel-end hold-down 144. Generally, linkage mechanism 140 provides for the fore and aft movement of binding 112 relative to ski 104 in a controlled manner and inhibits the toe end of the binding from disengaging the ski, and hold-down 144 inhibits the heel end of the binding from disengaging the ski. Linkage mechanism 140 includes a pair of guide/stop members 148 (only one is seen, the other is on the opposite side of binding 108) and a number of links 152 and pivot pins 156 forming a double-action linkage 160. As discussed below in more detail and shown in the drawings, guide/stop members 148 include respective slots 164 for guiding linkage 160 through a predetermined range of motion and stops 168 for limiting the movement of the linkage.

As those skilled in the art will readily appreciate, linkage mechanism 140 shown is merely exemplary and that a variety of other mechanism (not shown) may be used in the alternative. For example, double-action linkage 140 may be eliminated and laterally projecting pins be added to member 120 so as to move within corresponding respective slots. In order to reduce friction, a low-friction bearing may be used between each pin and member within the respective slot. In this case, fore and aft movement of binding 108 relative to ski could be controlled by action of springs 172A-B (FIG. 2) within heel unit 112 and limited by the mechanical limits of the parts of the heel unit. In other alternative embodiments, such control and limits may be supplemented or replaced by the use of one or more of various types of springs, e.g., coil springs, torsion springs, compression members (e.g., rubber), spiral springs, flat springs, leaf springs, etc., and stop components in toe end linkage mechanism 140 or in another location between binding 108 and ski 104. An example showing such alternative use of springs and stop components to inhibit relative movement between a binding of the present invention and a ski to which such binding is mounted is shown in FIGS. 1-1 to 1-5 of U.S. Provisional Application Ser. No. 60/652,977 titled "Device For Improving The Release And Retention Performance Of Ski Bindings" of C. Ettlinger that is incorporated herein by reference in its entirety. Those skilled in the art will understand that the resistance(s) of the springs used will be largely dictated by the force conditions under which binding 108 is designed to provide its upward heel release threshold changing functionality. The determination of such resistances is a matter of routine design using conventional engineering principles.

Heel-end hold-down 144 shown includes a pair or rollers 176 (one on each side of binding 108, better seen in FIG. 1) that engage the upper surface 180 of member 120 at least in an uplift condition and preferably at all times. Each roller 176 is secured to ski 104 by a corresponding roller support 184 (FIG. 1) fixedly secured to the ski. Those skilled in the art will readily appreciate that roller-type hold-downs 144 are merely exemplary and that the hold-downs shown may be replaced by any of a wide variety of other hold-downs (not shown), such as hold-downs that engage corresponding slots (not shown) formed in the sides of member 120, spring-loaded hold-downs, sliding hold-downs or one or more hold-downs that engage corresponding respective channels (not shown) formed in member 120. Generally, the only requirements of a suitable hold-down are that it keeps binding 108 in proper engaging with ski 104 and that it allows the binding to move as needed to provide the upward heel retaining threshold functionality of heel unit 112.

Figure 2:
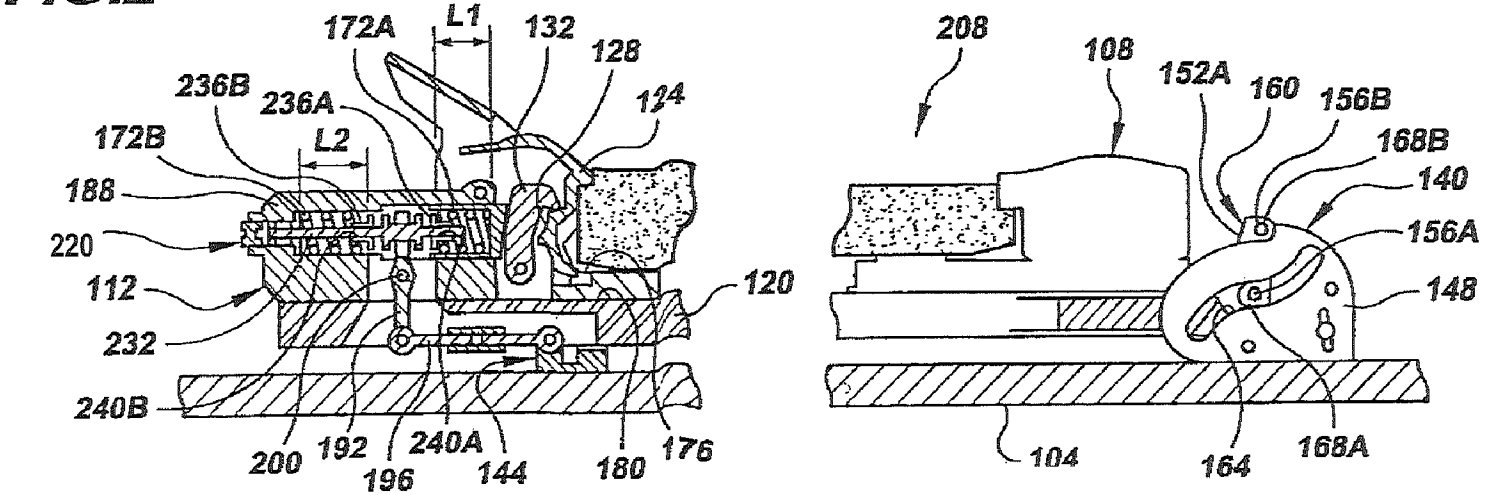
FIG. 2 is an enlarged partial longitudinal cross-sectional view and partial elevational view of the binding and snow ski of FIG. 1 showing the binding in a non-compensating retaining state.

Referring now to FIG. 2, heel unit 112 includes a housing 188 that houses cam follower 132 and pair of coaxial springs 172A-B that work against the housing to urge the cam following against cam surface 128 on heel cup 124. Heel unit 112 also includes a compensating lever 192 having one end located between springs 172A-B and one end pivotably attached to an adjustable link 196 that, in turn, may pinned to hold-down 144 or other structure fixed relative to ski 104. A fulcrum pin 200 fixed relative to housing 188 extends through compensating lever 192 at a location between the two ends of the lever. Those skilled in the art will readily understand that compensating lever 192 may be replaced by another mechanism (not shown), e.g., a multi-link mechanism, gear mechanism or hybrid thereof, that achieve the same result. Indeed, depending upon the configuration of heel unit 112, it may be necessary to have a more complex mechanism to obtain the necessary mechanical advantage to affect springs 172A-B. Adjustable link 196 may be adjusted for fine-tuning binding 108 and/or controlling the amount of play in the binding. With these additional parts of heel unit 112 in mind, figure pairs consisting of FIGS. 2 and 5, FIGS. 3 and 6 and FIGS. 4 and 7 illustrate, respectively, the operation of binding 108 in a non-compensating retaining state 208 (i.e., the state in which the heel release threshold is at its conventionally determined value), a release threshold increasing state 212 (such as would occur in response to Bow Effect conditions) and a release threshold decreasing state 216 (such as would occur in response to Sub-Near-Point Loading conditions.

Figure 4:
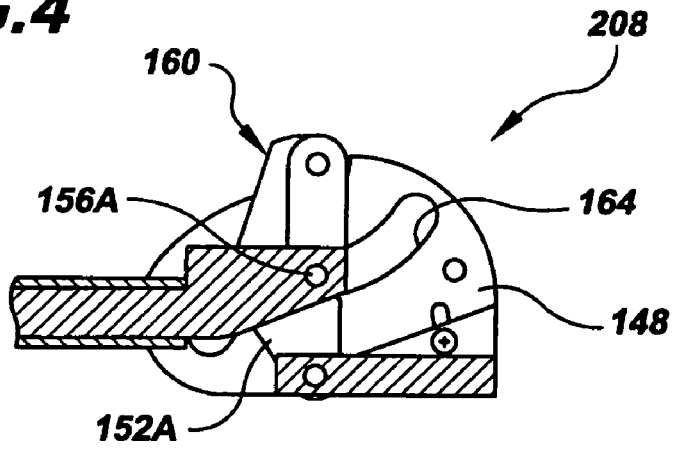
FIG. 4 is a side elevational view of the toe unit and double-action linkage mechanism of FIG. 1 with the proximate guide-slot plate of the mechanism removed and showing the mechanism in a non-compensating state.

Referring to FIGS. 2 and 4, which show binding 108 in non-compensating retaining state 208, and particularly to FIG. 2, springs 172A-B within heel unit 112 have respective non-compensating compressed lengths L1, L2. It is noted that heel unit 112 will typically be provided with a base-threshold adjusters 220 for adjusting lengths L1, L2 so as to adjust the base upward heel release threshold (which corresponds to the conventional upward heel release threshold) to suit a particular skier and other requirements. As with conventional heel units, the providing of adjuster 220 allows a single heel unit or binding to be sold to a range of skiers requiring a corresponding range of base upward heel release thresholds to reduce manufacturing complexity of making completely custom heel units. That said, in alternatively embodiments base-threshold adjuster 220 can be eliminated so that custom springs and/or custom compressed lengths are required for customization.

Adjuster 220 may include an actuating shaft 232 and spring stops 236A-B generally fixed relative to the actuating shaft so as to be movable with the shaft. As discussed above, as compensating lever 192 pivots relative to its fulcrum, it either causes actuating shaft 232 to move forward (relative to ski) so as to further compress spring 172A and reduce the compression of spring 172B, or afterward so as to further compress spring 172B and reduce the compression of spring 172A. Actuating shaft 232 may also be configured to function as part of an adjusting mechanism for adjusting the base upward heel release threshold. For example, actuating shaft 232 may be rotatable about its longitudinal axis and threaded with two opposite-hand thread sets 240A-B. Correspondingly, spring stops 236A-B threadedly engage respective thread sets 240A-B so that when actuating shaft 232 is rotated in one direction, the spring stops move away from each other, and when rotated in the opposite direction, the spring stops move toward each other. When spring stops 236A-B are moved away from each other, both springs 172A-B become more compressed, thereby increasing the base release threshold. Conversely, when spring stops 236A-B are moved toward each other both springs 172A-B become less compressed so as to decrease the base release threshold As seen in FIGS. 2 and 4, in non-compensating retaining state 208, the ends of pivot pin 156A of linkage 160 are located substantially in the longitudinal centers of the corresponding respective generally S-shaped slot 164, and pivot pins 156A-B are engaged with or in close proximity to respective stop 168A (best seen in FIG. 6) located on guide/stop member 148 and stop 168B located on link 152A.

Figure 3:
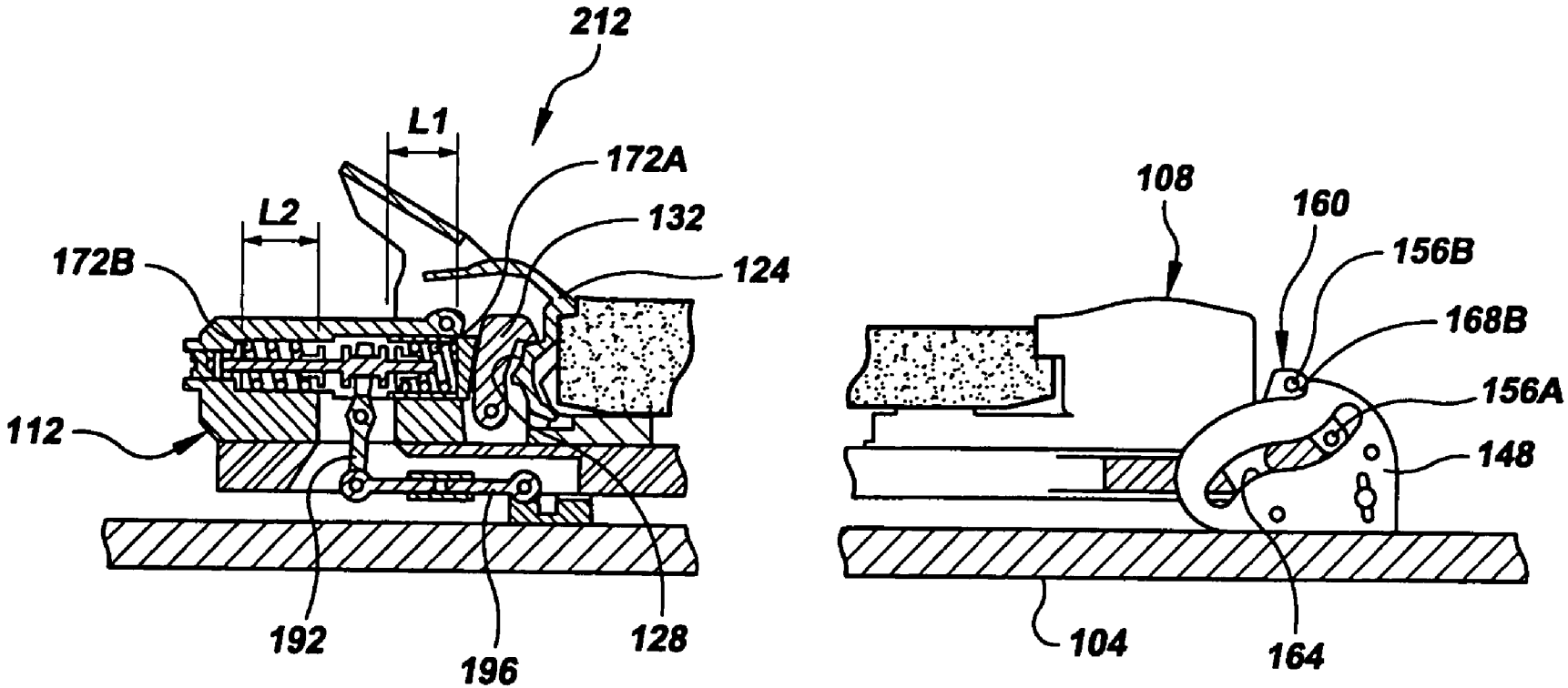
FIG. 3 is an enlarged partial longitudinal cross-sectional view and partial elevational view of the binding and snow ski of FIG. 1 showing the binding in a release threshold increasing state.
Figure 5:
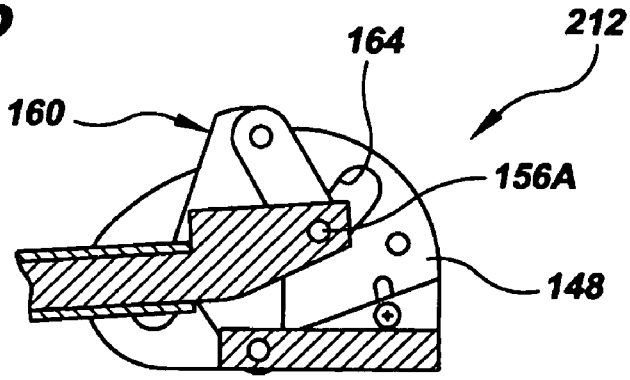
FIG. 5 is a side elevational view of the toe unit and double-action linkage mechanism of FIG. 1 with the proximate guide-slot plate of the mechanism removed and showing the mechanism in a release threshold increasing state.

Referring now FIGS. 3 and 5, and also to FIGS. 2 and 4 for comparison if desired, FIGS. 3 and 5 show binding 108 in heel release threshold increasing state 212. In this state 212, as particularly shown in FIG. 3, relative movement of ski 104 afterward relative to binding 108 causes link 196 to pivot compensating lever 192 clockwise, thereby decreasing compressed length L1 of spring 172A. Decreasing compressed length L1 of spring 172A increases the bias of cam follower 132 against cam surface 128 of heel cup 124, which in turn increases the upward heel release threshold of the heel cup. In the case of the Bow Effect, this increase in upward heel release threshold reduces the tendency of heel unit 112 to release the heel of the ski boot when such release is not desired. FIGS. 3 and 5 also show that the ends pivot pin 156A of linkage 160 are located in the forward and upward portions of the corresponding respective S-shaped slots 164 and the ends of pivot pin 156B are engaged with corresponding respective stops 168B (best seen in FIG. 6) on guide/stop members 148.

Figure 6:
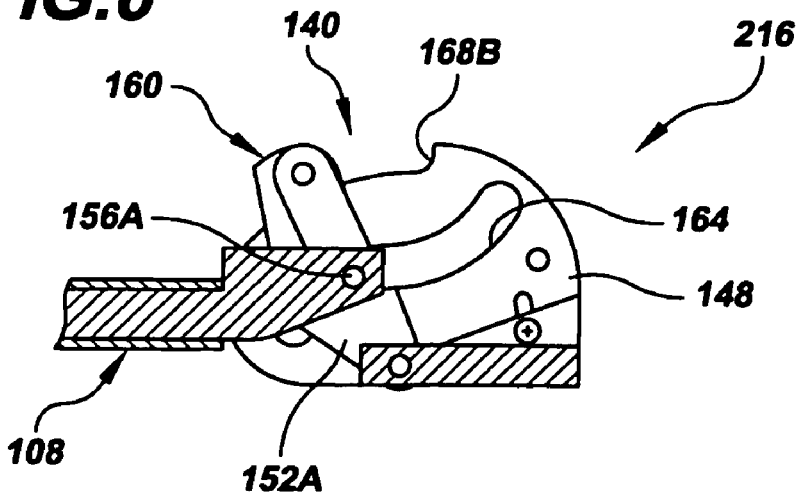
FIG. 6 is a side elevational view of the toe unit and double-action linkage mechanism of FIG. 1 with the proximate guide-slot plate of the mechanism removed and showing the mechanism in a release threshold decreasing state.

FIG. 6 illustrate binding 108 in heel release threshold decreasing retaining state 216. As ski 104 (FIG. 1) moves forward relative to binding 108, the ends of pivot pin 156A of toe-end linkage mechanism 140 are located in the afterward and lower portions of the corresponding respective S-shaped slots 164 of guide/stop members 148 and are also engaged with respective stops 168B on link 152A. Although heel unit 112 is not shown in heel release threshold retaining state 216, with reference to FIG. 2 it can be readily seen that when ski 104 moves forward relative to binding 108, link 196 pushes on compensating lever 192 so as to cause the lever to pivot counterclockwise so as to increase compressed length L1 of spring 172A and, consequently, decreasing the bias of cam follower 132 against cam surface 128. This decrease in bias force results in a reduction in the upward release threshold of heel retainer 124.

Still referring to FIG. 2, those skilled in the art will readily appreciate than in an alternative binding of the present invention, compensating lever 192 may be located outside of the heel unit, as indicated by arrow 300 that illustrates moving the compensating lever to a position aft of the heel unit. Such an alternative heel unit would operate in substantially the same manner as heel unit 112 of FIGS. 1-6 and would be particularly suited to for use with conventional heel unit housings, since the modifications to a conventional housing would be minimal. In contrast, if heel unit 112 of FIGS. 1-6 were made using a suitable conventional heel unit housing, the housing would require greater modification to accommodate "internal" compensating lever 192. Even though the compensating lever of this alternative heel unit is located outside of the heel unit housing, if the alternative binding were used with a dual-action mechanism, such as toe-end linkage mechanism 140 of FIGS. 1-6, the heel unit would operate in largely the same way as heel unit 112 of FIGS. 1-6.

Figure 7:
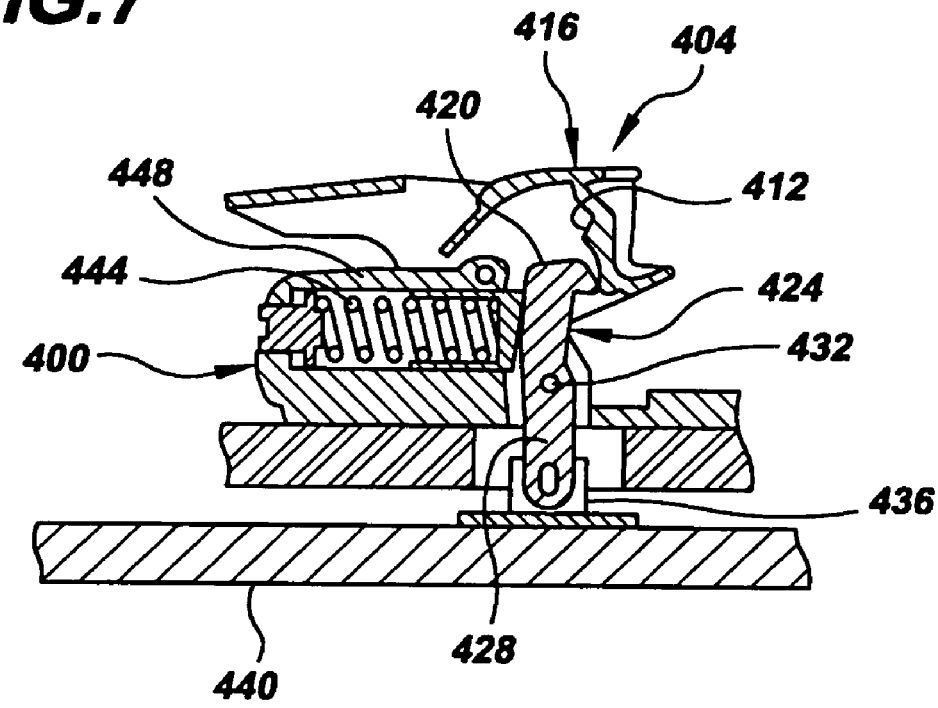
FIG. 7 is a longitudinal cross-sectional view of an alternative heel unit of the present invention having a release threshold compensating pivoting cam follower showing the heel unit in a released state.
Figure 8:
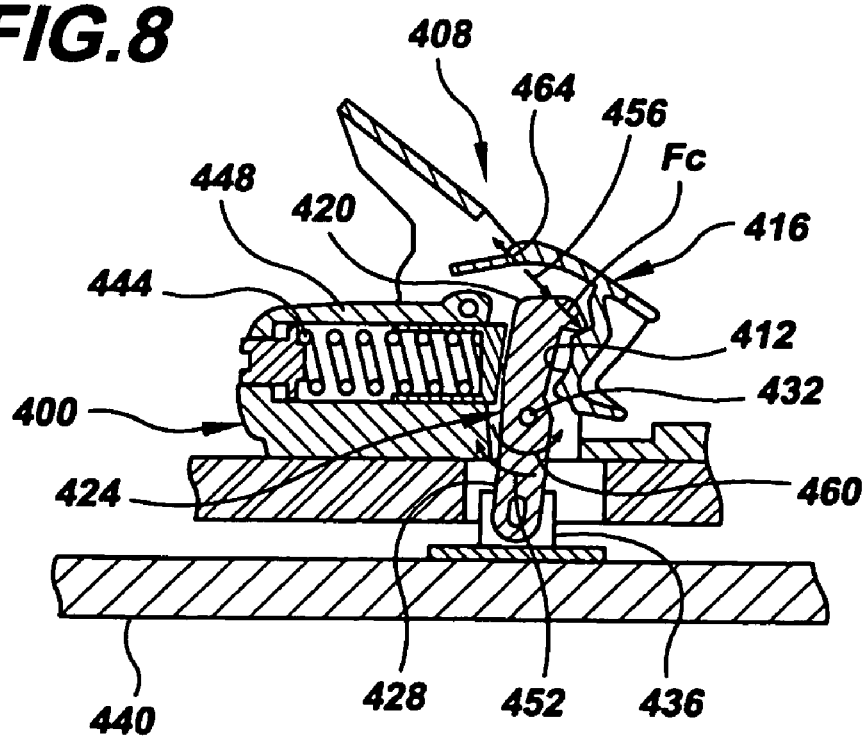
FIG. 8 is a longitudinal cross-sectional view of the heel unit of FIG. 7 showing the heel unit in a closed state.

FIGS. 7 and 8 illustrate another alternative heel unit 400 of the present invention in, respectively, a released state 404 and a closed, or retaining, state 408. Like the alternative heel unit just described, heel unit 400 may, but need not necessarily, be made by modifying a conventional heel unit. Some conventional heel units have a pivoting cam follower that engages a cam surface not unlike the cam surface 412 of the cup-type heel retainer 416 shown in FIGS. 8 and 9. Heel unit 400 includes a pivoting cam follower 420 that is generally similar to a conventional pivoting cam follower. However, cam follower 420 is different from a conventional cam follower in that it is part of a compensating lever 424 that also includes a lower extension 428 that extends below a fulcrum pin 432 of the cam follower so as to engage an actuator 436 fixed relative to ski 440. While cam follower 420 is biased into engagement with cam surface 412 in a conventional manner by a spring 444 located in the heel unit housing 448, the presence of extension 428 and a moveable mount (not shown) that allows the entire binding (not shown), i.e., heel unit 400 and a toe unit, to move relative to ski 440, give the heel unit the ability to change the upward heel release threshold of the heel unit.

In particular, under conditions when ski 440 moves aftward relative to heel unit 400, or is tending to move aftward if play does not exist in the system, the action of the ski causes, or attempts to cause (if no play exists), compensating lever 424 to rotate clockwise (arrow 452), thereby causing an increase (vector 456) in the contact force Fc applied by cam follower 420 to cam surface 412 in response to the compression of spring 444. Again, such conditions may result from the Bow Effect described in the Background section above. Conversely, under a conditions when ski 440 moves forward relative to heel unit 400, or is tending to move forward, the action of the ski causes, or attempts to cause, compensating lever 424 to rotate counterclockwise (arrow 460) so as to cause a decrease (vector 464) in contact force Fc applied by cam follower 420 to cam surface 412 in response to the compression of spring 444. Heel unit 400 may be provided with conventional adjustment means for adjusting the base heel release threshold.

As those skilled in the art will appreciate, if there is little play in the system comprising actuator 436 and compensating lever 424, the range of relative movement that needs to be provided between ski 440 and heel unit 400 (and the entire binding) can be small relative to the range of relative movement needed in a design that involves the shortening and/or lengthening of the compressed length(s) of one or more springs, such as the designs illustrated in FIGS. 1-6. This is so because the only movement that will occur, assuming there is no play between actuator 436 and extension 428 of compensating lever 424, will be due to the elastic deformation of the various parts under the particular loading conditions. In most foreseeable cases, these elastic deformations will be small.

As mentioned above, a binding of the present invention can be designed to compensate for various conditions encountered during skiing by either increasing the upward heel release threshold or decreasing this threshold, or both. Each of the three heel units disclosed above are described as providing both an increase and a decrease in the upward heel release threshold, depending upon the conditions at issue. This is accomplished in each of the three designs by using a double-action mount, e.g., double-action linkage mechanism 140 of FIGS. 1-6, that allows both forward and aftward conditional forces to be transmitted from the ski to the heel unit in a controlled manner.

Those skilled in the art will readily understand that if only movement in one direction is desired, i.e., in either a forward or aftward direction, double-action mechanism 140 of FIGS. 1-6 may be replaced by, e.g., a single-action mechanism. A single action mechanism may be used with any of heel units described above, or another compensating heel unit of the present invention. Such single-action mechanism may be a linkage-type mechanism similar to double-action mechanism 140 of FIGS. 1-6, except that it allows the binding to only move forward relative to the ski.

Figure 9:
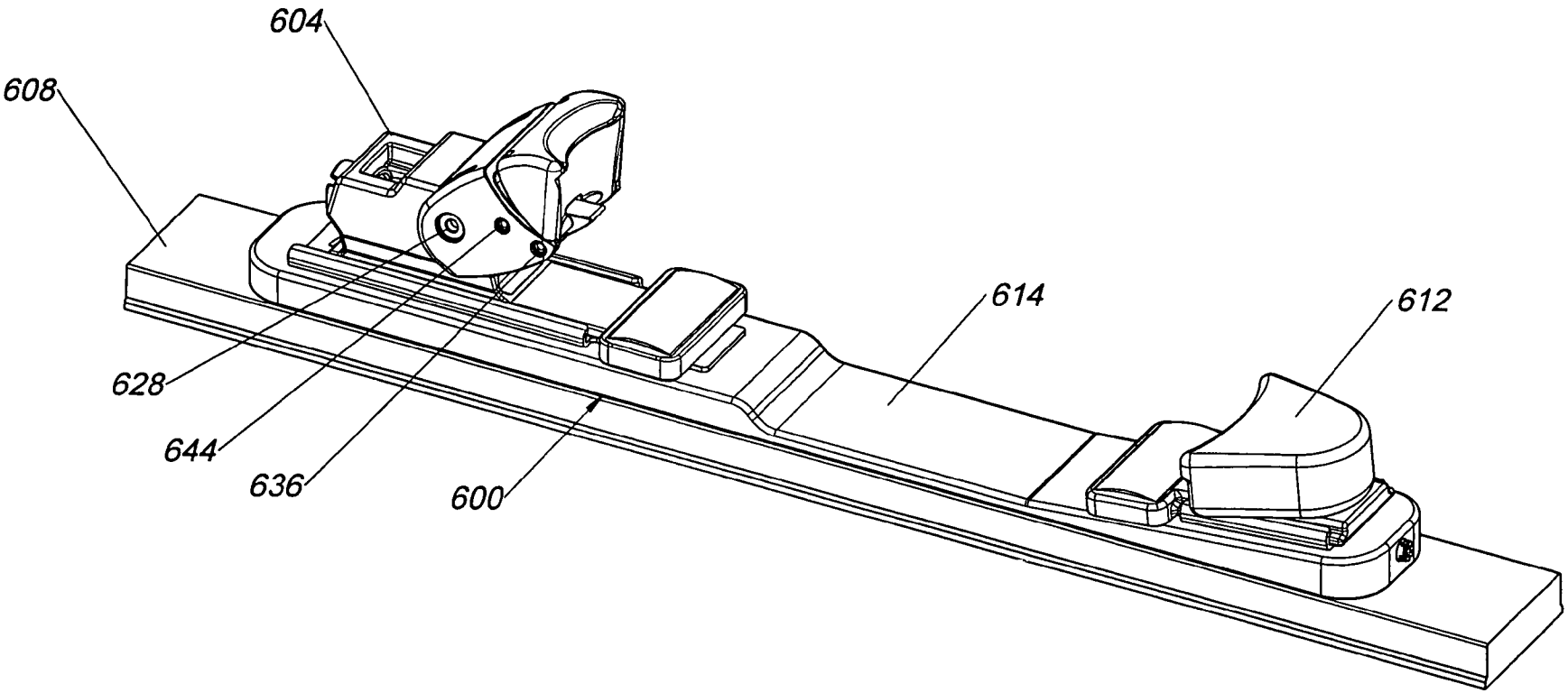
FIG. 9 is a perspective view of an alternative binding of the present invention shown mounted to a snow ski.

FIG. 9 illustrates an alternative binding 600 of the present invention that increases the upward heel release threshold of the heel unit 604 under conditions in which the ski boot (illustrated by the sole portion 606 of the boot) secured in the binding moves, or tends to move, forward relative to the ski 608, such as would occur during the Bow Effect described above in the Background section. Binding generally includes heel unit 604 and a toe unit 612 each secured to a base member 614 in a suitable manner. Generally and as described below in greater detail, the operation of binding 600 depends on the ability of the ski boot heel (not shown) to move away from heel unit 604 in a direction toward the leading end of ski 608 by a controlled amount. In the embodiment shown, this is accomplished by fixing heel unit 604 relative to ski 608 and base member 614 and making toe unit 612 movable relative to the ski and the base member. However, it should be appreciated that this is not the only way to achieve the requisite movement between the ski boot and heel unit 604. For example, in alternative embodiments (not shown) both heel unit 604 and toe unit 612 may be fixed relative to ski 608 and the toe unit provided with a plunger-type toe cup that allows the boot to move forward relative to the housing of the toe unit. In other embodiments, heel unit 604 may be movable relative to the ski boot. For example, toe unit 612 may be fixed relative to ski 608 and include a plunger-type toe cup that, when it moves forward, actuates a linkage that moves heel unit 604 rearward. Those skilled in the art will appreciate that other alternatives are possible.

Figure 10:
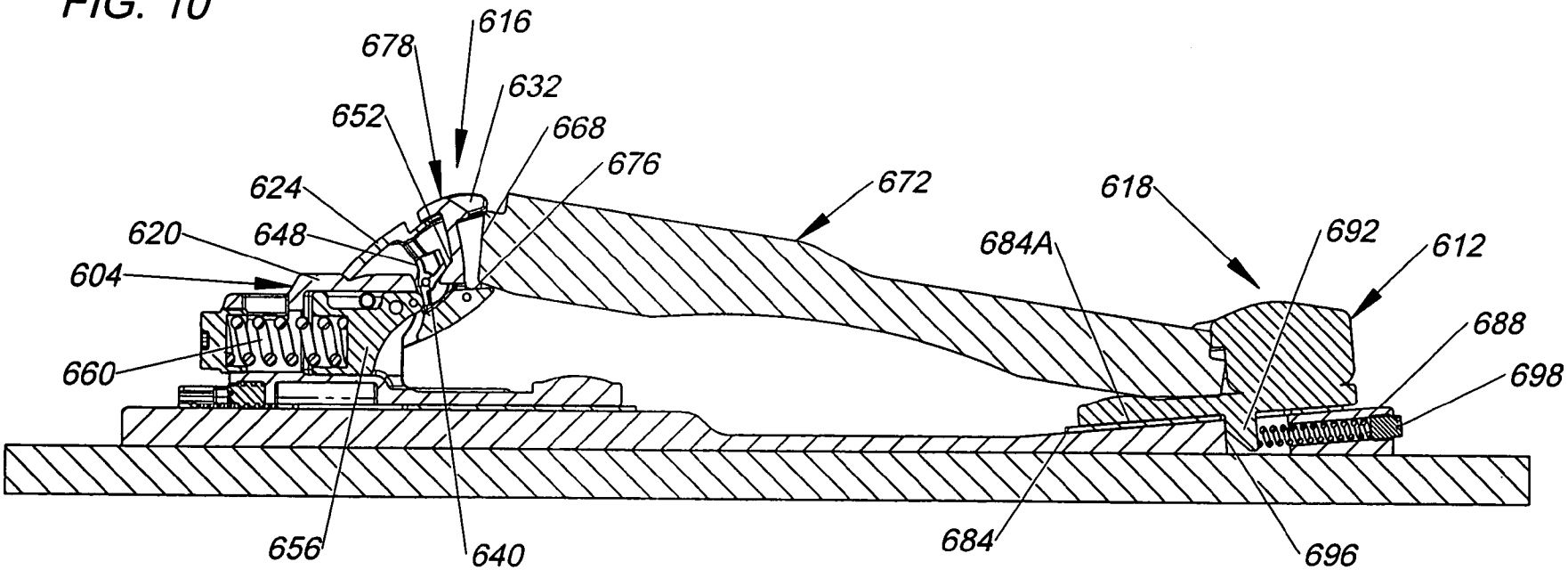
FIG. 10 is a longitudinal cross-sectional view of the binding and snow ski of FIG. 9 showing the binding in a released state.

FIG. 10 illustrates heel unit 604 in a releasing, or open, state 616 and toe unit 612 in a boot-receiving state 618. As seen in FIG. 12, heel unit 604 includes a housing 620, a secondary heel cup 624 pivotably attached to the housing at pivot 628 (FIG. 9) and a primary heel cup 632 pivotably attached to the secondary heel cup at pivot 636 (FIG. 9). A secondary cam follower 640 is also pivotably attached to secondary heel cup 624, at pivot 644 (FIG. 9), and includes a primary cam surface 648. Primary heel cup 632 includes a secondary cam surface 652 engaged by secondary cam follower 640. Housing 620 contains a plunger-type primary cam follower 656 that is urged into engagement with primary cam surface 648 by an urging spring 660. When in release position 616 shown, primary cam follower 656 is urged against a lower portion of primary cam surface 648 of secondary cam follower 640, which is constrained from rotating counterclockwise (as viewed in the figure) any further than shown even though the primary cam follower is urging the secondary cam follower in a counterclockwise direction. The shape of secondary cam surface 652 of primary heel cup 632 and the interference of the secondary cam surface with secondary cam follower 640 inhibits the primary heel cup from rotating clockwise so as to simplify engaging a heel lug 668 of a ski boot (represented by sole portion 672 of the boot) with heel unit 604. As heel lug 668 is engaged with heel unit 604, a skier causes the heel lug to push downward on a closing surface 676 of primary heel cup 632 so as to pivot the assembly 678 comprising secondary heel cup 624, the primary heel cup and secondary cam follower 640 clockwise so as to place the heel unit into the non-compensating retaining state 680 shown in FIG. 11.

Still referring to FIG. 10, toe unit 612 is secured to base member 614 so as to be slidable in a direction substantially away from heel unit 604 along a surface fixed relative to the base member, such as surface 684A of a low-friction bearing 684 affixed to the base member. Surface 684A may be inclined relative to the upper surface of ski 608, or not, as needed to achieve the desired controlled movement of toe unit 612 relative to heel unit 604. Toe unit 612 may be biased into its boot-receiving state 618 by one or more biasing devices, such as spring 688 shown. In the present design, spring 688 engages a lower appendage 692 of toe unit 612 that is urged into contact with a contact surface 696 on base member 614 when the toe unit is in boot-receiving state 618. As discussed below, when ski boot 672 is releasably engaged in a properly set-up binding 600, the boots will essentially be clamped between heel unit 604 and toe unit 612 so that spring 688 will be compressed at least slightly, thereby urging the boot against the heel unit. As those skilled in the art will appreciate, spring 688 and surface 684A may be designed to provide the necessary movement of toe unit 612 and ski boot 672 to provide any initial urging of ski boot 672 against heel unit 604 and to activate the heel release threshold compensation of binding 600. Base member 614 may be provided with an adjustment screw 698 or other adjustment means for adjusting the bias of spring 688 to suit a particular binding setup.

Figure 11:
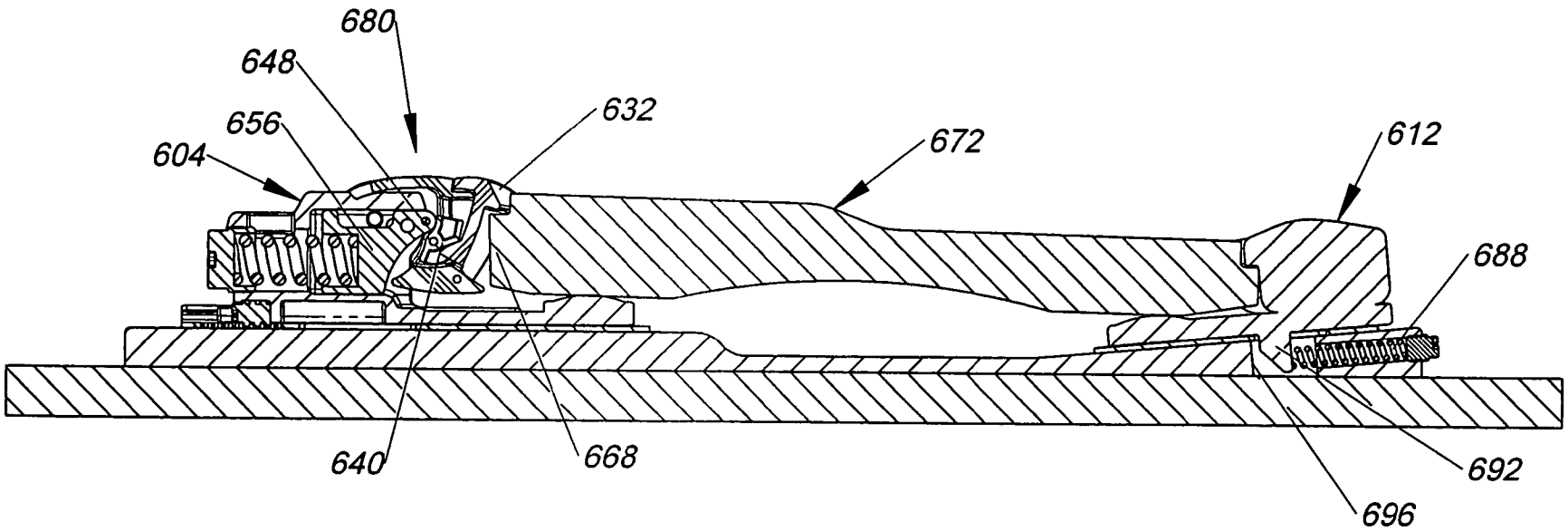
FIG. 11 is a longitudinal cross-sectional view of the binding and snow ski of FIG. 9 showing the binding in a non-compensating state.
Figure 12:
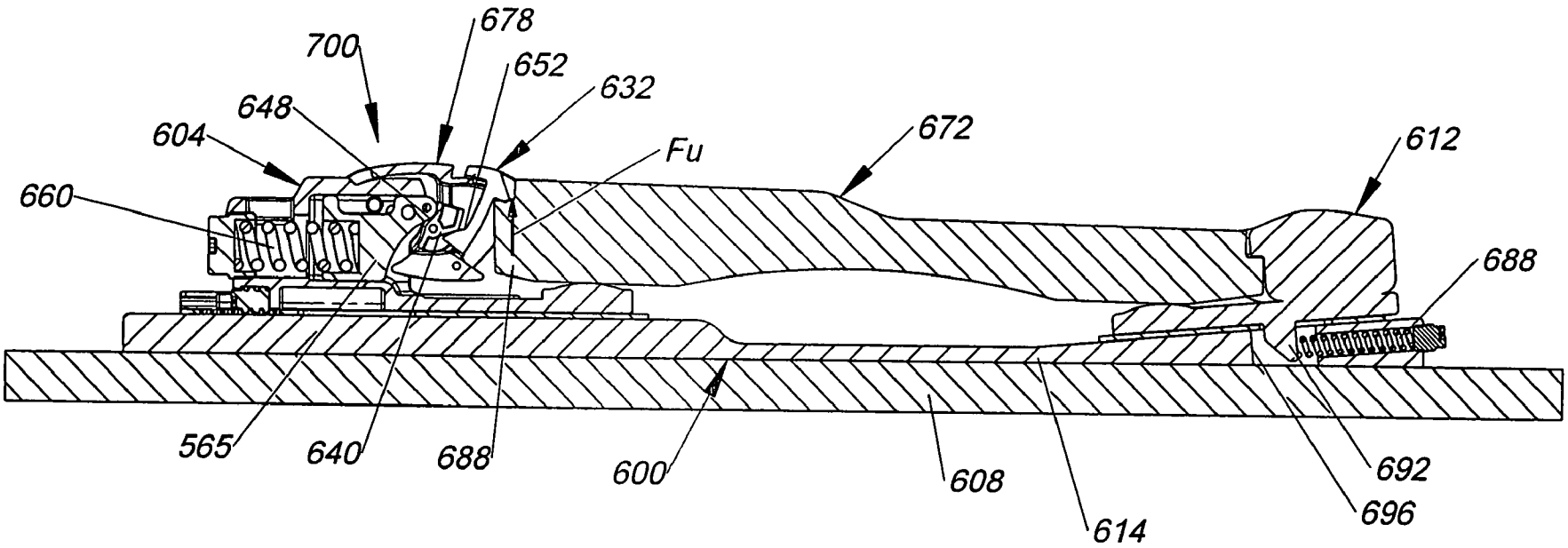
FIG. 12 is a longitudinal cross-sectional view of the binding and snow ski of FIG. 9 showing the binding in a release threshold increasing state.

As seen in FIG. 11, when heel unit 604 is in non-compensating retaining state 680, primary cam follower 656 is engaged with an upper portion of primary cam surface 648 on secondary cam follower 640, thereby urging the secondary cam follower to rotate clockwise and urge primary heel cup 632 in a clockwise direction into retaining engagement with heel lug 668 of ski boot 672. Non-compensating retaining state 680 is the state of heel unit 604 in which assembly 678 provide a base release threshold. As mentioned above, in non-compensating retaining state 680, spring 688 is compressed so that ski boot 672 is urged against heel unit 604. This is seen by the gap between contact surface 696 and lower appendage 692 of toe unit 612.

FIG. 12 illustrates heel unit 604 in a release threshold increasing state 700 that is achieved when ski boot 672 moves away from the heel unit, a condition that occurs, e.g., during a Bow Effect event. When the forces acting between ski boot 672 and binding 600 are such that spring 688 further compresses from its initial retaining state as shown in FIG. 11 so that heel lug 668 moves away from heel unit 604 (and the upward load Fu applied by the heel lug to primary heel cup 632 that is less than the release threshold of assembly 678), the movement of the heel lug no longer constrains primary heel cup from pivoting toward the leading edge of ski 608. (Note the additional gap between contact surface 696 of base member 614 and lower appendage 692 of toe unit 612 and the more forward position of heel lug 668 of ski boot 672 relative to heel unit 604.) This allows secondary cam follower 640 to pivot clockwise against the urging from primary cam follower 656 and spring 660. Therefore, primary heel cup 632 and secondary cam follower 640 pivot clockwise into the positions shown. Note that the new contact angles between primary cam follower 656 and the upper portion of primary cam surface 648 and between secondary cam follower 640 and secondary cam surface 652 are greater than in non-compensating retaining state 680 shown in FIG. 11. The increase in contact angles causes an increase in the upward heel release threshold of heel unit 604. As upward load Fu applied by heel lug 668 to primary heel cup 632 becomes greater, entire assembly 678 is pivoted counterclockwise, causing upper portion 684 of primary cam surface 648 to slide along primary cam follower 656.

Figure 13:
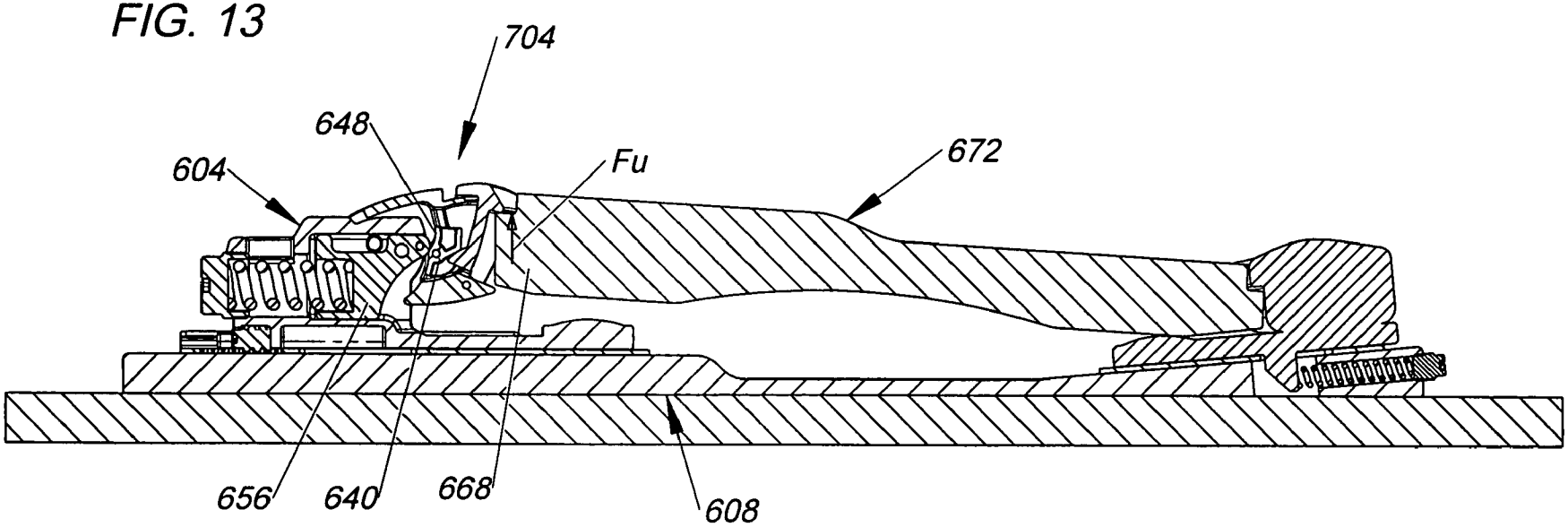
FIG. 13 is a longitudinal cross-sectional view of the binding and snow ski of FIG. 9 showing the state of the binding when the heel unit is at its release threshold.

FIG. 13 shows a state 704 of heel unit 604 at the limit of it elastic travel during a release in response to an upward load Fu that exceeds the increased upward heel release threshold. In this state, the leading edge of primary cam follower 656 is just at the cusp of primary cam surface 648 of secondary cam follower 640. Once the cusp of primary cam surface 648 moves upward past the leading edge of primary cam follower 656, the leading edge of the primary cam follower begins following the lower portion of the primary cam surface. Due to the change in the contact angle between primary cam follower 656 and primary cam surface 648 after the leading edge of the primary cam follower passes the cusp of the primary cam surface, the heel release resistance of heel unit 604 reduces below the increased threshold, allowing heel lug 668 to release from the heel unit and the boot to release from binding 600.

The embodiments of the present invention described above all utilize mechanical means to sense the forces and/or movements that occur between the ski and the ski boot during a compensating event, e.g., a Bow Effect event or a Sub-Near-Point loading event. Although not shown, alternatives exist that do not require such mechanical means. For example, the sensing of the forces and/or relative movements may be replaced by sensing of one or more accelerations using one or more suitable accelerometers. For example, a multi-axis accelerometer may be affixed to the ski for measuring accelerations in a plane containing the longitudinal central axis of the ski and extending in a direction perpendicular to the upper surface of the ski. Such an accelerometer may output one or more acceleration signals that may be used by an electronic heel unit that electronically adjusts the base heel release threshold as a function of the acceleration signal(s). Suitable accelerometers are available or could be readily custom made using conventional design principles known to those skilled in the art. In addition, the general concept of electronic bindings is known. Consequently, with the guidance of the present disclosure an artisan or ordinary skill in the art could readily fashion an electronic binding/accelerometer system that would fall within the broad scope of the present invention.

Although the invention has been described and illustrated with respect to exemplary embodiments thereof, it should be understood by those skilled in the art that the foregoing and various other changes, omissions and additions may be made therein and thereto, without parting from the spirit and scope of the present invention.

What is claimed is:

1. A ski binding configured to be secured to a snow ski and to retain a ski boot having a heel, a toe, a sole, and a longitudinal boot axis extending between the heel and the toe, wherein the sole has a bottom facing toward the snow ski when the ski boot is retained in the ski binding and the ski binding is secured to the snow ski, wherein the snow ski has, when the ski boot is properly secured in the ski binding, a trailing end located rearward of the heel of the ski boot and a leading end located forward of the toe of the ski boot, the ski binding comprising:

a heel unit that includes a releasing heel retainer having a retaining state and a released state, said releasing heel retainer configured to inhibit movement of the heel of the ski boot when in said retaining state, said heel retainer having an uplift release threshold between said retaining state and said release state; and an uplift-release-threshold compensator operatively configured to either, or both:

increase, during skiing, said uplift release threshold in response to a bow-effect-loading vector that applies 1) a non-zero first component to the ski binding from the snow ski in a direction toward the trailing end of the snow ski and 2) a non-zero second component proximate the leading end of the snow ski that tends to pry the snow ski away from the heel of the ski boot; and decrease, during skiing, said uplift release threshold in response to a sub-near-point-loading vector that applies 1) a non-zero third component to the ski binding from the snow ski in a direction toward the leading end of the snow ski and 2) a non-zero fourth component proximate the toe of the ski boot that tends to pry the snow ski away from the heel of the ski boot.

2. A ski binding according to claim 1, wherein said releasing heel retainer comprises a cam and a cam follower having a bias against said cam, said uplift-release-threshold compensator configured to change said bias so as to change said uplift release threshold.

3. A ski binding according to claim 2, wherein said heel unit further comprises at least one first spring substantially providing said bias of said cam follower against said cam and having a first compressed length, said uplift-release-threshold compensator configured to change said bias by changing said compressed length.

4. A ski binding according to claim 3, wherein said uplift-release-threshold compensator comprises a compensating lever for changing said first compressed length in response to movement between said heel unit and the snow ski in a direction substantially parallel to the longitudinal boot axis.

5. A ski binding according to claim 3, wherein said heel unit further comprises at least one second spring in series with said at least one first spring and having a second compressed length.

6. A ski binding according to claim 5, wherein said uplift release threshold compensator comprises a compensating lever for changing each of said first and second compressed lengths simultaneously with one another in response to movement between said heel unit and the snow ski in a direction substantially parallel to the longitudinal boot axis.

7. A ski binding according to claim 6, wherein a portion of said compensating lever is located between said first spring and said second spring.

8. A ski binding according to claim 2, wherein said cam follower is pivotable relative to said heel unit about a fulcrum and said uplift-release-threshold compensator changes said bias by lever action of said cam follower about said fulcrum.

9. A ski binding according to claim 2, further comprising a toe unit fixed relative to said heel unit so as to form a binding assembly, said release-threshold compensator comprising a displacing mount for securing said binding assembly to the snow ski so that said binding assembly is movable relative to the snow ski in a direction substantially parallel to the longitudinal boot axis when the binding assembly is secured to the snow ski and the ski boot is captured in the binding assembly.

10. A ski binding according to claim 9, wherein said displacing mount comprises a toe-end mechanism located proximate said toe unit.

11. A ski binding according to claim 10, wherein said toe-end mechanism comprises a single action linkage that allows said uplift-release-threshold compensator to either increase said uplift release threshold or decrease said uplift release threshold in response to said predetermined input.

12. A ski binding according to claim 10, wherein said toe-end mechanism comprises a double action linkage that allows said uplift-release-threshold compensator to increase said uplift release threshold in response to said bow-effect-loading vector and decrease said uplift release threshold in response to said sub-near-point-loading vector.

13. A ski binding according to claim 9, wherein said displacing mount is a single action mount that allows said uplift-release-threshold compensator to either increase said uplift release threshold in response to differential movement between the snow ski and the binding assembly in a direction substantially rearward relative to the ski boot or decrease said uplift release threshold in response to movement between the snow ski and the binding assembly in a direction substantially forward relative to the ski boot.

14. A ski binding according to claim 9, wherein said releasing mount is a double action mount that allows said uplift-release-threshold compensator to increase said uplift release threshold in response to movement between the snow ski and the binding assembly in a direction substantially rearward relative to the ski boot and decrease said uplift release threshold in response to differential movement between the snow ski and the binding assembly in a direction substantially forward relative to the ski boot.

15. A ski binding according to claim 1, wherein said releasing heel retainer comprises a secondary heel cup and a primary heel cup movable relative to said secondary heel cup.

16. A ski binding according to claim 15, wherein said uplift-release-threshold compensator comprises a rocker cam biasing said primary heel cup.

17. A system, comprising:

a snow ski having a leading end and a trailing end;

a binding secured to said snow ski and configured to retain a ski boot having a heel, a toe, a sole, and a longitudinal boot axis extending between the heel and the toe, wherein the sole has a bottom facing toward said snow ski when the ski boot is retained in said binding, said binding comprising:

a heel unit that includes a releasing heel retainer having a retaining state and a released state, said releasing heel retainer configured to retain the heel of the ski boot when in said retaining state, said heel retainer having an uplift release threshold between said retaining state and said release state; and an uplift-release-threshold compensator operatively configured to either, or both:

increase, during skiing, said uplift release threshold in response to a bow-effect-loading vector that applies 1) a non-zero first component to said binding from said snow ski in a direction toward said trailing end of said snow ski and 2) a non-zero second component proximate said leading end of said snow ski that tends to pry said snow ski away from the heel of the ski boot; and decrease, during skiing, said uplift release threshold in response to a sub-near-point-loading vector that applies 1) a non-zero third component to said binding from said snow ski in a direction toward said leading end of said snow ski and 2) a non-zero fourth component proximate the toe of the ski boot that tends to pry said snow ski away from the heel of the ski boot.

18. A system according to claim 17, wherein said releasing heel retainer comprises a cam and a cam follower having a bias against said cam, said uplift-release-threshold compensator configured to change said bias so as to change said uplift release threshold.

19. A system according to claim 17, wherein said releasing heel retainer comprises a secondary heel cup and a primary heel cup movable relative to said secondary heel cup.

20. A system according to claim 17, wherein said binding further comprises a toe unit fixed relative to said heel unit, said binding being movable relative to said snow ski in a direction substantially parallel to said longitudinal boot axis during use of the system while skiing so as to actuate said uplift-release-threshold compensator.

21. A system according to claim 17, wherein said binding further comprises a toe unit movable relative to said heel unit in a direction substantially parallel to said longitudinal boot axis during use of the system while skiing so as to actuate said uplift-release-threshold compensator.

22. A ski binding configured to be secured to a snow ski and to retain a ski boot having a heel, a toe, a sole, and a longitudinal boot axis extending between the heel and the toe, wherein the sole has a bottom facing toward the snow ski when the ski boot is retained in the ski binding and the ski binding is secured to the snow ski, wherein the snow ski has, when the ski boot is properly secured in the ski binding, a trailing end located rearward of the heel of the ski boot and a leading end located forward of the toe of the ski boot, the ski binding comprising:

first means for releasably retaining the heel of the ski boot on the snow ski when the ski binding is secured to the snow ski, said first means having a boot heel uplift resistance; and second means for either, or both:

increasing, during skiing, said boot heel uplift resistance in response to a bow-effect-loading vector that applies 1) a non-zero first component to the ski binding from the snow ski in a direction toward the trailing end of the snow ski and 2) a non-zero second component proximate the leading end of the snow ski that tends to pry the snow ski away from the heel of the ski boot; and decreasing, during skiing, said boot heel uplift resistance in response to a sub-near-point-loading vector that applies 1) a non-zero third component to the ski binding from the snow ski in a direction toward the leading end of the snow ski and 2) a non-zero fourth component proximate the toe of the ski boot that tends to pry the snow ski away from the heel of the ski boot.

23. A ski binding according to claim 1, wherein said uplift release threshold compensator is operatively configured to only increase, during skiing, said uplift release threshold in response to said bow-effect vector.

24. A ski binding according to claim 1, wherein said uplift release threshold compensator is operatively configured to only decrease, during skiing, said uplift release threshold in response to said sub-near-point-loading vector.

25. A ski binding according to claim 1, wherein said uplift release threshold compensator is operatively configured to both increase, during skiing, said uplift release threshold in response to said bow-effect vector and decrease, during skiing, said uplift release threshold in response to said sub-near-point-loading vector.

26. A system according to claim 17, wherein said uplift release threshold compensator is operatively configured to only increase, during skiing, said uplift release threshold in response to said bow-effect vector.

27. A system according to claim 17, wherein said uplift release threshold compensator is operatively configured to only decrease, during skiing, said uplift release threshold in response to said sub-near-point-loading vector.

28. A system according to claim 17, wherein said uplift release threshold compensator is operatively configured to both increase, during skiing, said uplift release threshold in response to said bow-effect vector and decrease, during skiing, said uplift release threshold in response to said sub-near-point-loading vector.

29. A ski binding according to claim 22, wherein said second means is for only increasing, during skiing, said uplift release threshold in response to said bow-effect vector.

30. A ski binding according to claim 22, wherein said second means is for only decreasing, during skiing, said uplift release threshold in response to said sub-near-point-loading vector.

31. A ski binding according to claim 22, wherein said second means is for both increasing, during skiing, said uplift release threshold in response to said bow-effect vector and decreasing, during skiing, said uplift release threshold in response to said sub-near-point-loading vector.

* * * * *